US005234394A

United States Patent [19]

Wilkinson

[11] Patent Number: 5,234,394

[45] Date of Patent: Aug. 10, 1993

[54] UNIVERSAL, PORTABLE EXERCISE APPARATUS ADAPTABLE TO FIT A CHAIR

[76] Inventor: William T. Wilkinson, P.O. Box 378, Chesapeake City, Md. 21915

[21] Appl. No.: 690,567

[22] Filed: Apr. 24, 1991

[51] Int. Cl.[5] ..... A63B 21/00

[52] U.S. Cl. ..... 482/92; 482/121; 482/124

[58] Field of Search ..... 272/900, 142, 145, 138, 272/136, 131, 134; 482/130, 133

[56] References Cited

U.S. PATENT DOCUMENTS

| | | | |
|---|---|---|---|
| 1,973,945 | 9/1934 | Chavin | 272/134 |
| 4,557,480 | 12/1985 | Dudley | 272/131 |
| 5,007,632 | 4/1991 | Wilkinson | 272/142 |
| 5,080,353 | 1/1992 | Tench | 482/130 |
| 5,090,694 | 2/1992 | Pauls et al. | 482/130 |

FOREIGN PATENT DOCUMENTS

| | | | |
|---|---|---|---|
| 0122944 | 8/1901 | Fed. Rep. of Germany | 482/133 |
| 0220034 | 3/1910 | Fed. Rep. of Germany | 482/133 |
| 3901578 | 8/1990 | Fed. Rep. of Germany | 482/130 |
| 2815083 | 10/1979 | Fed. Rep. of Germany | 272/134 |

*Primary Examiner*—Stephen R. Crow

*Assistant Examiner*—Jerome Donnelly

*Attorney, Agent, or Firm*—E. Alan Uebler

[57] ABSTRACT

Portable exercise apparatus adaptable to fit a chair is provided. The apparatus comprises, in combination: (1) a back support removeably attachable to the backrest of a conventional chair; (2) at least one elongate extension member removeably and adjustably affixed to the back support such that the extension member extends through a point of reference located at a desired height on an imaginary vertical line which essentially bisects the backrest of the chair, the extension member extending through the point of reference and outwardly therefrom within a substantially vertical plane containing the line, the plane being parallel to and adjacent to the backrest of the chair, the outward end of the extension member having attached thereto, (3) a resistance mechanism to create resistance against movement, the resistance mechanism being engageable by a limb of a person when sitting in the chair. The apparatus has virtually an infinite number of resistance position locations which can provide universal exercise for arms, legs, back, neck, abdomen, ankles and wrists and which, in addition, is inexpensive to manufacture.

8 Claims, 2 Drawing Sheets

UNIVERSAL, PORTABLE EXERCISE APPARATUS ADAPTABLE TO FIT A CHAIR

BACKGROUND OF THE INVENTION

This invention relates to apparatus for exercising the human body, more specifically, portable exercise apparatus adaptable to fit most chairs, which apparatus provides universal and total exercise for the arms, legs, abdomen, back, neck, ankles and wrists of the user while the user is sitting in a chair. While exercising according to the invention, the user may be occupied by other things, such as watching television.

Different types of exercise apparatus are known. Many are complex, or limited in versatility in terms of the number of muscle groups an individual apparatus can adequately develop, and, not least in importance, are very expensive.

The apparatus of the invention is a virtually universal exercise device and is inexpensive, being adaptable to fit conventional chairs in support thereof.

The steadily increasing recognition of the importance of exercise in the maintenance of good health has led to a daily attention to such exercise by many people. The limited time available and the need for proper control and regulation of exercise to avoid harmful side effects has led to an increasing popularity of exercising apparatus designed to fulfill this need.

Such apparatus generally makes provision for controlled resistance to a repetitive physical movement. As the participant gradually improves his muscle tone and general physical condition, the resistance to such movement is slowly increased. In many instances, such participants develop to such an extent that the resistance can be increased to a many-timesmultiple of that which initially is employed.

Exercise apparatus included in chair means is also known. For example, the Nordic Track Company markets a chair apparatus having horizontal extensions extending outwardly from the back thereof and having resistance means therein which may be pulled repeatedly. See, e.g., *Nordic Track Bulletin* NFC-2-01 (1990).

However, none of the known prior art devices provides portable, universal exercise apparatus, having virtually an infinite number of resistance position locations, which can provide universal exercise for arms, legs, back, neck, abdomen, ankles and wrists and which, in addition, is inexpensive.

SUMMARY OF THE INVENTION

Portable exercise apparatus adaptable to fit a chair is provided. The apparatus comprises, in combination, a back support means removeably attachable to the backrest of a conventional chair, at least one elongate extension member removeably and adjustably affixed to the support means such that the extension member extends through a point of reference located at a desired height on an imaginary vertical line which essentially bisects the backrest of the chair, the extension member extending through the point of reference and outwardly therefrom within a substantially vertical plane containing the line, the plane being parallel to and adjacent to the backrest of the chair, the outward end of the extension member having resistance means attached thereto to create resistance against movement, the resistance means being engageable by a limb of a person when sitting in the chair. The extension member may extend horizontally from the chair through the point of reference located at the approximate shoulder height of a user of the apparatus. The location of the extension member is adjustable vertically on the support means, and the outward projection of the extension means is adjustable lengthwise. The extension member may extend vertically upwardly, vertically downwardly or both vertically upwardly and downwardly. The extension member may be affixed to a rotatable hub affixed to the support means, which hub can be rotated throughout 360° and which can be fixed at any desired angular position, the axis of rotation of the hub extending through the point of reference perpendicularly to the vertical plane. The resistance means may comprise elastic cords, springs or weights connected by a cable to handle means engageable by a limb of a person when sitting in the chair. The apparatus may include a plurality of extension members.

DETAILED DESCRIPTION OF THE INVENTION AND PREFERRED EMBODIMENTS WITH REFERENCE TO THE DRAWINGS

Portable exercise apparatus adapted to fit a chair is provided. The apparatus comprises, in combination: (1) a back support removeably attachable to the backrest of a conventional chair; (2) at least one elongate extension member removeably and adjustably affixed to the support such that the extension member extends through a point of reference located at a desired height on an imaginary vertical line which essentially bisects the backrest of the chair, the extension member extending through the point of reference and outwardly therefrom within a substantially vertical plane containing the line, the plane being parallel to and adjacent to the backrest of the chair, the outward end of the extension member having attached thereto, (3) a resistance mechanism to create resistance against movement, the resistance mechanism being engageable by a limb of a person when sitting in the chair. The apparatus has virtually an infinite number of resistance position locations which can provide universal exercise for arms, back, neck, abdomen, ankles and wrists and which, in addition, is inexpensive to manufacture.

Figure 1:
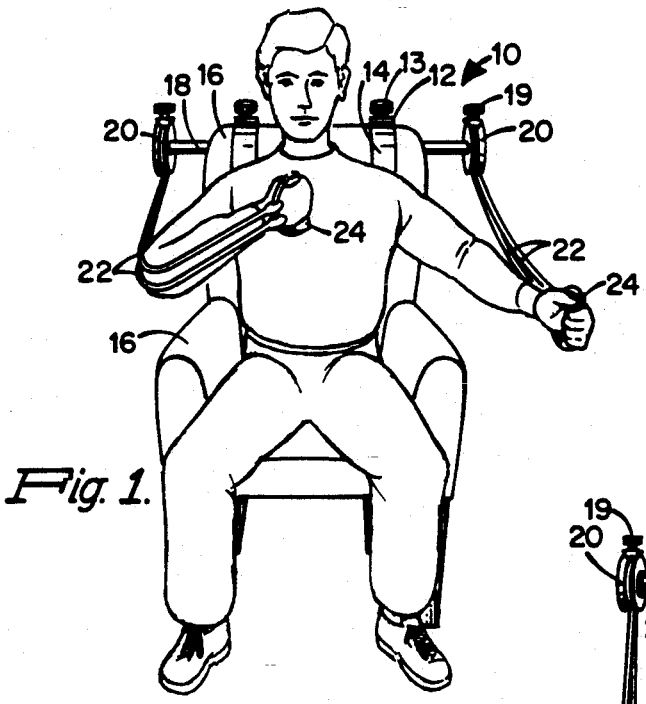
FIG. 1 is a schematic front elevational view of a person exercising in one embodiment according to the invention.

A detailed description of the invention and preferred embodiments is best provided with reference to the accompanying drawings wherein FIG. 1 depicts a front elevational, schematic view of a person sitting in a chair equipped with the exercise apparatus of the invention and performing repetitive arm exercises. In FIG. 1, the exercise apparatus 10 is shown fitted to chair 16 by means of rear support 12, described in detail below, affixed to front support straps 14 by fastening means 13. Horizontal extension member 18, which may be of rigid plastic, aluminum or other similar and suitable material, extends horizontally outwardly on both sides of said chair 16 at a vertical height which corresponds approximately to the shoulder height of the person exercising, while he sits in the chair 16. Attachment assemblies 20, which may include pulley and brake mechanisms discussed below, affixed to the outer ends of extension member 18 as shown, provide for anchoring of the resistance means 22 which, in the embodiment illustrated, are elastic cords 22 having handles 24 which may be grasped by the user.

The user, while sitting in chair 16, may grasp handles 24 and perform repetitive pulling exercises, thereby exercising his arms, shoulders and wrists, all while possibly being engaged in other activity such as watching television. One may also perform back exercises by positioning handles 24 in front of the user and leaning forward at the waist using the back muscles to push forward against the resistance of the resistance cords 22.

The cords 22 may actually comprise a set of interchangeable pairs of cords covering a range of elastic tensions, and thus enabling a wide variety of persons, i.e., children through adults, very weak to very strong, to use the exercise apparatus of the invention.

Figure 2:
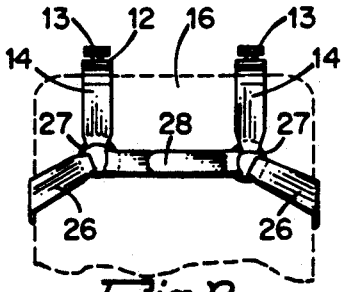
FIG. 2 shows a front view of strap means for affixing the apparatus of the invention to a conventional chair.

FIG. 2 shows the front fastening means for the apparatus depicted in FIG. 1. In FIG. 2, the front of the backrest of the chair 16, broken away and in phantom, is shown in front elevation. Rear support means 12 is affixed to the backrest of chair 16 by fastening means 13 and front vertical straps 14 and horizontal straps 26, all held together by rings 27. Straps 14 and 26 may be of any suitable material such as nylon. The ends of the horizontal straps 26 may be held together in the center of the backrest of chair 16 by means of Velcro® closure 28, or by other suitable closures.

Figure 3:
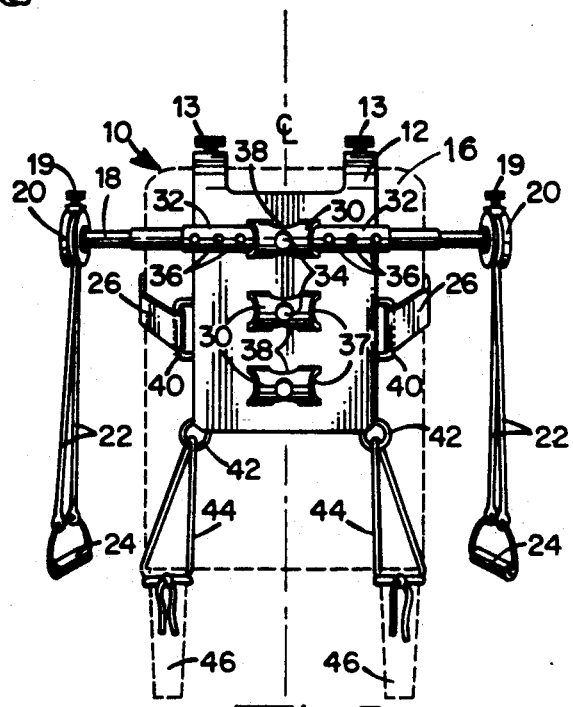
FIG. 3 is a rear elevation of the apparatus depicted in FIG. 1.

FIG. 3 shows a schematic rear elevation of the embodiment of the invention 10 depicted in FIG. 1. The invention includes rear support bracket 12 mounted on chair 16 by means of fasteners 13 and straps 26, the latter held by strap anchors 40 attached as shown to rear support bracket 12. Imaginary vertical line L, shown dotted, bisects chair 16 vertically. Rear support brackets 30 have top and bottom openings 38 therein to allow for vertical placement of the extension member(s) therethrough and side openings 37 therein to allow for horizontal placement of the extension member(s) therethrough. Extension members 18 are shown extending horizontally through extension adjustment tubes which in turn extend through openings 37 of the uppermost support bracket 30, which is at the approximate vertical height of the shoulders of a user sitting in chair 16. The horizontal extension member assembly 18, 32 is adjustable lengthwise by telescopic adjustment of member 18 and anchoring at the desired location by set screws 34.

At the outer ends of the extension members 18 are fixed attachment means 20 held in place by fastening means 19. The fastening means 19 hold resistance means 22 to the horizontal extension members 18. The resistance means 22 in this instance are elastic cords having handles 24 at their outer ends for grasping by the user.

The vertical height of the extension members 18 may be varied by changing the position of these members from one bracket 30 to another. Tie cords 4 affixed to back support 12 by means of rings 42 may be tied to the legs 46 of chair 16 to provide further support and rigidity to the apparatus 10.

Figure 3A:
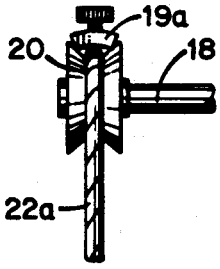
FIG. 3*a* is an exploded view of a pulley and weight assembly used to create resistance in the resistance means of the invention.

FIG. 3*a* shows schematically an alternative resistance means, being a rigid cable 22A affixed to weights (not shown) and passing over pulley 20 affixed to extension member 18, the tension in cable 22A being further controlled by friction brake mechanism 19A.

Figure 4:
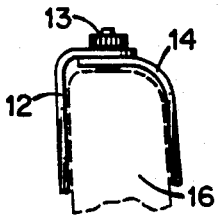
FIG. 4 and 4*a* shows one means for affixing the apparatus of the invention to a conventional chair.
Figure 4A:
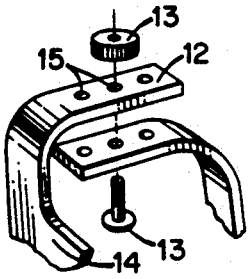

FIG. 4 and 4*a* shows one means for holding the back support bracket 12 to the back of chair 16, shown in phantom. Back support bracket is shown affixed to strap 14 by nut and bolt mechanism 13, further shown in an exploded view in FIG. 4*a*. Openings 15 in back support 12 and strap 14 permit the apparatus to be adapted to chairs having different thicknesses.

Figure 5:
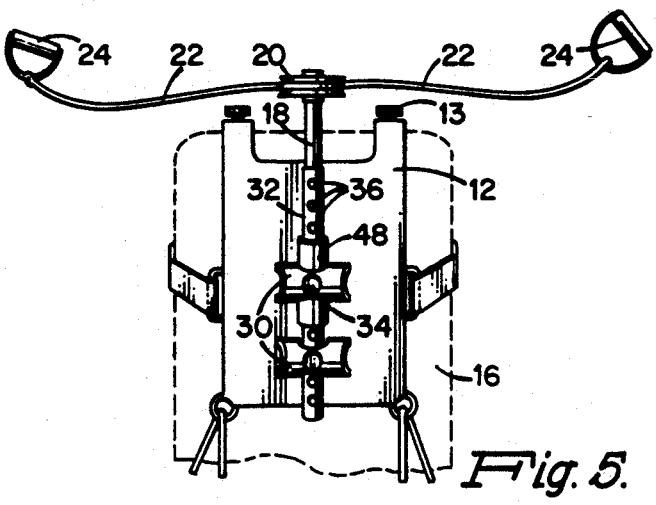
FIG. 5 shows a rear elevation of a second possible positioning of the apparatus according to the invention.

FIG. 5 shows an alternate arrangement in which extension member 18 is oriented vertically and the attachment assembly 20 and a pair of resistance means 22 (elastic cords) extend from a common origin approximately positioned behind the head of a user. Support 12 is affixed to chair 16 as before. The vertically oriented extension member 18 extends into extensible support 32 which is held in support brackets 30 by set screw 34 at the desired height.

Figure 6:
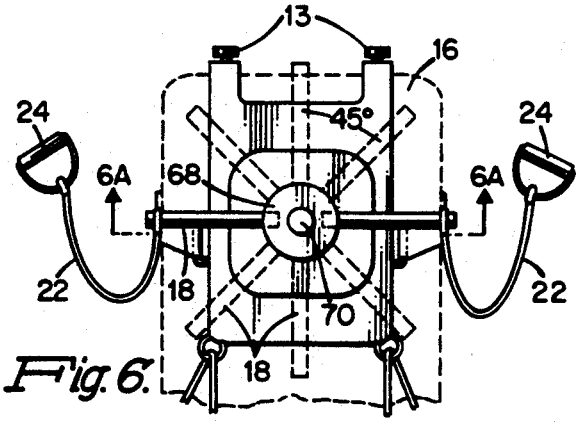
FIG. 6 shows a still further embodiment according to the invention in which the extensions and resistance means may be placed at any desired angular location throughout a full 360°.

FIG. 6 shows a still further embodiment in which the extension member(s) 18 are held by a rotatable hub assembly 68. Rotation is indicated by the double-headed arrow. The hub assembly 68 may be rotated and fixed there by tightening bolt 70, which affixes the entire assembly to the back of support bracket 12. Multiple extension members 18 may be employed, as indicated in phantom, for exercising both legs and both arms simultaneously. In this embodiment, elastic cords 22 having handles 24 are again depicted.

Figure 6A:
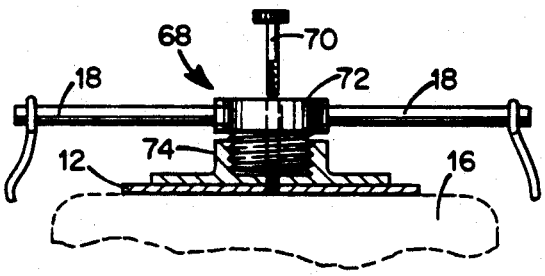
FIG. 6A is a cross-sectional view of the apparatus of FIG. 6 taken substantially along the line 6A—6A of FIG. 6.

FIG. 6A is a cross-sectional view taken substantially along line 6A—6A of FIG. 6. Therein, chair 16 (in phantom) has back support bracket 12 affixed thereto by means of bolt 70 which also extends through and supports hub 72 and hub receptacle bracket 74. Extension members 18 are held in hub 72, which is shown as a male-threaded cap assembly, which screws into female, threaded receptacle bracket 74. Once the desired angular orientation of the extension members 18 is set, the entire assembly 68 is fixed in place by tightening bolt 70.

Figure 7:
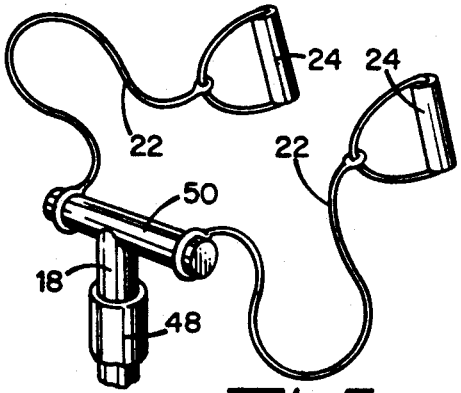
FIG. 7 is a view of "T"-bar apparatus useful in connection with the invention.

FIG. 7 shows a "T"-bracket 5D attached to an extension member 18 held in support sleeve 48. Elastic cords 22 with handles 24 may be affixed to the T-bracket 50 instead of the pulley attachment assembly 20.

Figure 8:
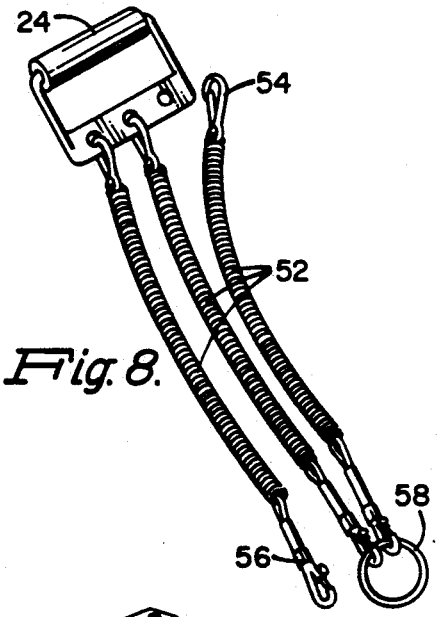
FIG. 8 shows spring resistance means for generating resistance in the apparatus of the invention.

FIG. 8 shows a further alternative resistance mean comprising springs 52 mounted by means of snap/clip/-loop assembly 56 and ring 58 to an attachment assembly 20. Handles 24 are attached to springs 52 by snap clips 54. Variable resistance may be provided by using different springs having different spring constants.

Figure 9:
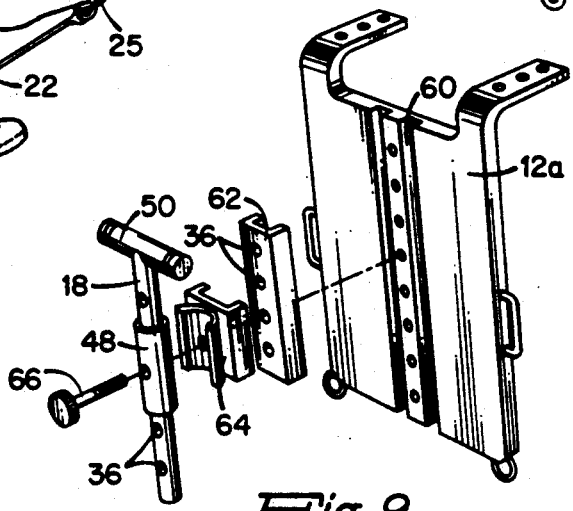
FIG. 9 is a schematic view of an alternative support means for affixing the apparatus of the invention to a chair.

FIG. 9 shows an exploded view of an alternative rear support bracket 12*a* having a slotted channel 60 for receiving a vertical angle bracket 62 which, in turn, holds, the extension member assembly. As shown, the T-support 50 is mounted at the end of extension member 18 which is held in support sleeve 48 and is lengthwise adjustable by means of openings 36 and bolt 66. The extension member and T-support assembly are held to back support 12*a* by means of adaptor bracket 64, as shown.

Figure 10:
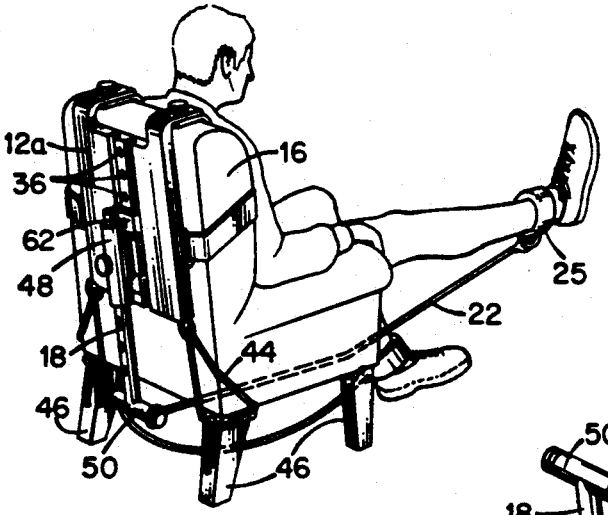
FIG. 10 is a schematic view of a person exercising a leg and ankle with the apparatus of the invention.

Use of this slotted channel support assembly to provide for leg and ankle exercise is depicted in FIG. 10 wherein like components have reference characters as described above and wherein the resistance cords 22 are affixed to a foot strap 25 which may be held to the foot by Velcro ® closures.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Portable exercise apparatus adapted to fit a chair, the apparatus comprising, in combination:

(a) At least one elongated extensible extension member, (b) Back support means removeably attachable to the back rest of a conventional chair wherein said back support means is affixed to the back rest of said chair by adjustable fastening means capable of accommodating chairs having backs of different thicknesses, said back support means having a plurality of bracket attachment means affixed thereto, and at least one rear support bracket, said rear support bracket being attachable to one of said bracket attachment means at a plurality of vertical positions along said back support, said rear support bracket having an opening therethrough through which said extension member passes, thereby permitting both vertical and horizontal adjustment of said extension member to accommodate various sizes of users of said exercise apparatus.

(c) said at least one elongated extensible extension member removeably and adjustable affixed to said back support means such that said extension member extends through a point of reference located at a desired height on an imaginary vertical line which essentially bisects said back rest of said chair, said extension member extending through said point of reference and outwardly therefrom within a substantially vertical plane containing said line, said plane being parallel to and adjacent to said backrest of said chair, the outward ends(s) of said extension member having attached thereto.

(d) Resistance means to create resistance against movement, said resistance means being engageable by a limb of a person when sitting in said chair.

2. The apparatus of claim 1 affixed to a chair, said extension member extending horizontally through said point of reference and outwardly therefrom on both sides of said chair, which point is at the approximate shoulder height of a user of said apparatus sitting in said chair.

3. The apparatus of claim 1 affixed to a chair, the location of said extension member being adjustable vertically on said back support means.

4. The apparatus of claim 1 affixed to a chair, wherein the length of the outward projection of said extension member is adjustable.

5. The apparatus of claim 1 wherein said resistance means comprises elastic cords.

6. The apparatus of claim 1 wherein said resistance means comprises springs.

7. The apparatus of claim 1 including a plurality of said extension members.

8. The apparatus of claim 1 wherein said resistance means comprises a cord and pulley whose resistance is controlled by a friction brake.

* * * * *